US008243971B2

(12) United States Patent
Kornagel

(10) Patent No.: US 8,243,971 B2
(45) Date of Patent: Aug. 14, 2012

(54) BEHIND-THE-EAR HEARING DEVICE HAVING AN EXTERNAL, OPTICAL MICROPHONE

(75) Inventor: Ulrich Kornagel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1198 days.

(21) Appl. No.: 11/906,469

(22) Filed: Oct. 2, 2007

(65) Prior Publication Data

US 2008/0107292 A1 May 8, 2008

(30) Foreign Application Priority Data

Oct. 2, 2006 (DE) ..... 10 2006 046 700

(51) Int. Cl.
*H04R 25/00* (2006.01)

(52) U.S. Cl. ..... 381/312; 381/338

(58) Field of Classification Search ..... 381/312, 381/338

See application file for complete search history.

(56) References Cited

U.S. PATENT DOCUMENTS

| | | | | |
|---|---|---|---|---|
| 6,445,799 | B1 | 9/2002 | Taenzer et al. | |
| 2005/0251225 | A1* | 11/2005 | Faltys et al. | 607/57 |
| 2006/0107744 | A1 | 5/2006 | Li et al. | |
| 2006/0189841 | A1 | 8/2006 | Pluvinage | |
| 2006/0233398 | A1* | 10/2006 | Husung | 381/172 |
| 2007/0076913 | A1* | 4/2007 | Schanz | 381/381 |

FOREIGN PATENT DOCUMENTS

| | | | |
|---|---|---|---|
| DE | 3508830 | A1 | 9/1986 |
| DE | 69827245 | T2 | 3/2005 |
| DE | 10 2005 013 833 | B3 | 6/2006 |
| DE | 10 2005 006 404 | B3 | 8/2006 |
| WO | 9843567 | A1 | 10/1998 |

* cited by examiner

*Primary Examiner* — David Vu
*Assistant Examiner* — Brandon Fox

(57) ABSTRACT

An optically unnoticeable and acoustically improved behind-the-ear hearing device having a housing which can be worn behind the ear, a signal processing facility which is arranged in the housing, and which comprises an optoelectrical converter, and at least one optical microphone is provided. The optical microphone is arranged outside the housing and can be positioned in the concha or in the auditory canal. Furthermore, the optical microphone is connected to the signal processing facility by way of an optical wave guide for optical signal transmission purposes. An optical microphone of this type can be realized small and in an unnoticeable fashion on/in an otoplastic, such that during the acoustic recording, the typical frequency behavior through the concha can also be used.

15 Claims, 1 Drawing Sheet

BEHIND-THE-EAR HEARING DEVICE HAVING AN EXTERNAL, OPTICAL MICROPHONE

CROSS REFERENCE TO RELATED APPLICATIONS

This application claims priority of German application No. 102006046700.0 DE filed Oct. 2, 2006, which is incorporated by reference herein in its entirety.

FIELD OF INVENTION

The present invention relates to a behind-the-ear hearing device having a housing which can be worn behind the ear, a signal processing facility arranged in the housing, said signal processing facility comprising an optical converter and having at least one optical microphone. The present invention further relates to a corresponding method for recording sound for a behind-the-ear hearing device.

BACKGROUND OF INVENTION

Hearing devices are portable hearing apparatuses which are used to supply hearing-impaired persons. To accommodate the numerous individual requirements, different configurations of hearing devices such as behind-the-ear hearing devices (BTE), in-the-ear hearing devices (ITE), concha hearing devices, are provided. The hearing devices designed by way of example are worn on the outer ear or in the auditory canal. Furthermore, bone conduction hearing aids, implantable or vibrotactile hearing aids are also available on the market. The damaged ear is herewith either stimulated mechanically or electrically.

Essential components of the hearing devices include in principal an input converter, an amplifier and an output converter. The input converter is generally a receiving transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This basic configuration is shown in the example in FIG. 1 of a behind-the-ear hearing device. One or more microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is carried out by a battery 5 which is likewise integrated into the hearing device housing 1.

SUMMARY OF INVENTION

With BTE devices, the microphones generally sit in the housing behind the ear. The sound therefore does not experience the typical frequency behavior through the concha on its way to the microphone and/or microphones. The disadvantage here is that acoustic events are difficult to locate. It was thus already proposed to position the microphone or microphones in the concha, e.g. in the otoplastic. Conventional standard microphones with electrical supply are however too bulky and noticeable for this purpose.

Patent application DE 10 2005 013 833 B3 discloses a hearing aid apparatus with an optical microphone. Optical microphones are used on account of their robustness in relation to electromagnetic interferences and a chemically aggressive environment. Several optical microphones can be connected to a common optical fiber. This leads to advantages compared to a three-conductor cabling of an electromicrophone.

The publication DE 10 2005 006 404 B3 also discloses a modular hearing device system, which can be better individually adjusted to the requirements of a hearing device wearer. The hearing device system comprises an in-the-ear hearing device with a microphone, amplifier and loudspeaker. A hearing device extension module, which comprises a fastening facility for fastening to the head of a hearing device wearer, is used to extend or modify the functionality of the in-the-ear hearing device. The hearing device extension module can be used as an additional energy storage device for instance.

The object of the present invention consists in improving the acoustic characteristics of a behind-the-ear hearing device and herewith in simultaneously not significantly increasing but instead reducing the optical noticeability of the hearing device.

In accordance with the invention, this object is achieved by a behind-the-ear hearing device having a housing which can be worn behind the ear, a signal processing facility arranged in the housing, said signal processing facility having an optoelectrical converter and at least one optical microphone, with the optical microphone being arranged outside the housing and being positionable in the concha or in the auditory canal and the optical microphone for optical signal transmission being connected to the signal processing facility by way of an optical fiber.

In the present document, the term "optical microphone" is exclusively used for the acoustooptical converter. The connecting components for forwarding the optical signal and for optoelectrical conversion are not embraced here by said term.

In accordance with the invention, a method for recording sound for a behind-the-ear hearing device is provided, by means of acoustooptically converting the sound to be recorded in an auditory canal or in an concha into an optical signal, optically transmitting the optical signal to a housing of the behind-the-ear hearing device, optoelectrically converting the optical signal in the housing into an electrical signal for further processing by means of the behind-the-ear hearing device.

This advantageously ensures that the frequency behavior through the concha can also be used for the hearing device wearer. Furthermore, optical microphones can generally be realized relatively smaller, thereby rendering them optically less noticeable. Furthermore, optical wave guides are generally optically less rich in contrast, thereby rendering them hardly perceivable. Optical microphones are also less sensitive to perspiration than electrical microphones.

The optical wave guide is preferably a glass fiber cable. This can be realized very thin and in an optically less noticeable manner.

In accordance with an advantageous embodiment, the hearing device according to the invention has an otoplastic, onto which the optical microphone is fastened or into which the optical microphone is integrated. This allows the optical microphone to be fastened into/onto the auditory canal in a stable fashion. Instead of the otoplastic, any type of ear mold or ear piece can naturally also be used.

The otoplastic and/or the ear mold can also contain or hold a loudspeaker, in addition to the optical microphone. An electrical or magnetic crosstalk from the loudspeaker to the optical microphone is excluded here.

It is particularly advantageous if a connecting line from the hearing device housing to the auditory canal, which is used for the acoustic transport or acoustic generation, is also used to transmit optical signals. The respective connecting line herewith achieves a dual functionality. If the otoplastic comprises a loudspeaker for instance, which is connected to an electrical supply line on the hearing device housing which is worn behind the ear, an insulation tube of the supply line can be embodied as the optical wave guide in order to transmit the optical signal. If the sound from the hearing device housing is alternatively transported into the auditory canal with the aid of a sound tube, this sound tube can, at the same time, also be used as the optical wave guide in order to transmit the optical signal.

BRIEF DESCRIPTION OF THE DRAWINGS

The present invention is described in more detail with reference to the appended drawings, in which.

DETAILED DESCRIPTION OF INVENTION

The exemplary embodiments illustrated in more detail below represent preferred embodiments of the present invention.

Figure 1:
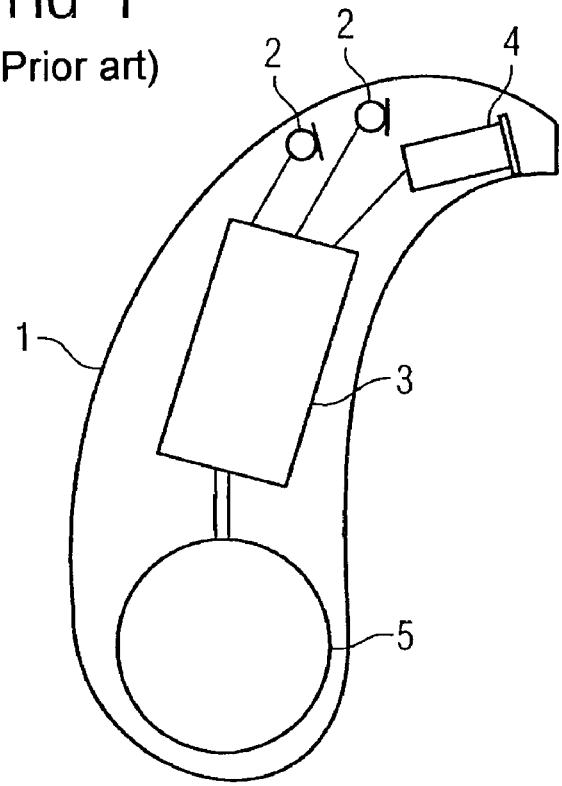
FIG 1 (Prior art)
FIG. 1 shows the main design of a behind-the-ear hearing device.
Figure 2:
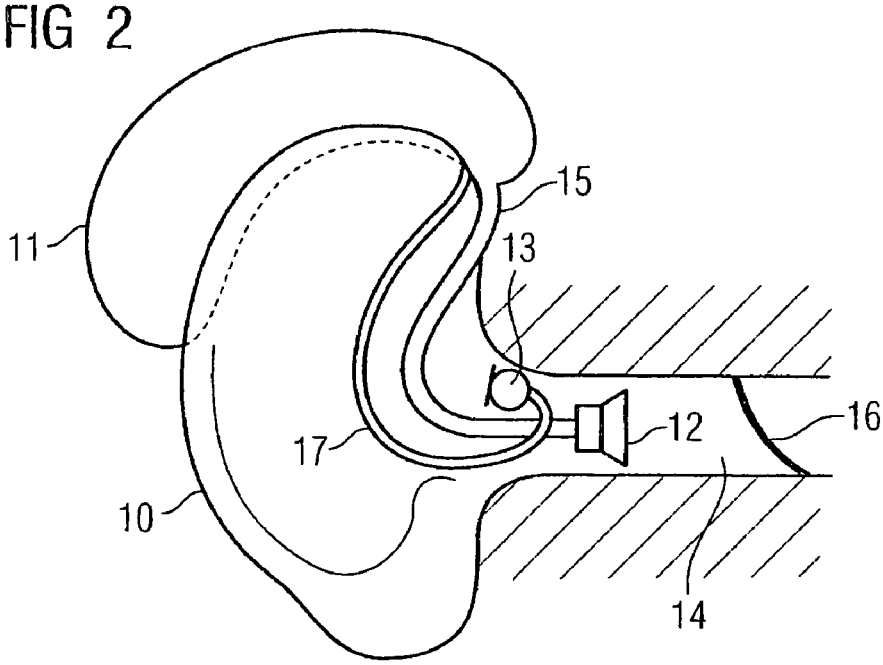
FIG. 2 shows a diagram of a behind-the-ear hearing device according to the invention in a worn state.

The diagram illustrated in FIG. 2 shows an exemplary behind-the-ear hearing device, which is worn behind a concha 10. This consists of a housing 11, which contains the essential signal processing components including the battery (cf. FIG. 1). In the example in FIG. 2, the loudspeaker 12 and the microphone, here an optical microphone 13, are removed from the hearing device housing 11. The loudspeaker 12 and the optical microphone 13 are fastened into the auditory canal 14 with the aid of an otoplastic, which is not shown in FIG. 2 for the sake of clarity.

The loudspeaker 12 is electrically connected to the hearing device housing 11 and/or the signal processing unit located therein with the aid of a conventional electronic cable 15. The loudspeaker 12 and/or the acoustic outlet is directed in the auditory canal approximately toward the ear drum 16. Instead of the electrical cable 15 and the loudspeaker 12, a sound tube can also be provided here in a simple fashion, in order to route the sound from a loudspeaker integrated in the housing 11 (see FIG. 1) into the auditory canal 14.

The otoplastic is, as mentioned, equipped with the optical microphone 13. In conventional form, this optical microphone 13 comprises a membrane, which is optically scanned. Accordingly, a light source is provided in the housing 11, the light of which is guided via an optical wave guide 17, which is guided parallel to the electrical cable 15 from the housing 11 to the otoplastic, toward the optical microphone 13. The light is reflected onto the membrane and interferences corresponding to the oscillations of the membrane result. The reflected light is transmitted back to the housing 11 by way of the optical wave guide 17. An optoelectrical converter, which is arranged upstream of the signal processing unit in the housing, converts the optical signal of the microphone 13 into an electrical signal for further processing.

In the simplest case, the optical microphone 13 is fastened in a simple manner to the otoplastic. The membrane can however also be integrated in the otoplastic shell and/or if necessary flush with the surface. The optical wave guide 17 is then guided from the side of the eardrum to the membrane for the purpose of reverse scanning of the membrane, as shown symbolically in FIG. 2.

According to a further development, the membrane is produced from the same material as the otoplastic. This thus enables it to be formed in one piece with the otoplastic using injection molding for instance. Even if the membrane consists of another material such as an otoplastic, it can be injected into the otoplastic using a suitable injection molding method.

An alternative embodiment thus consists in using an existing physical connection between the hearing device housing 11 and the otoplastic in order to transmit the optical signal of the optical microphone 13, instead of a single optical wave guide 17, as shown in FIG. 2. In the present example in FIG. 2, the insulating tube of the electrical cable 15 can be realized with a material for instance, which exhibits light conducting characteristics. The insulating tube of the electrical cable 15 is thus used as the optical wave guide in order to transmit the signals from the optical microphone to the hearing device signal processing. A crosstalk from the electrical loudspeaker supply to the microphone supply is also not a problem in this instance, since the loudspeaker and the microphone are electrically and/or optically supplied and/or tapped respectively In the case illustrated already above such that only a sound tube is guided from the hearing device housing 11 to the otoplastic in the auditory canal 14, the sound tube can also be designed as an optical wave guide. In this case, the sound tube thus also exhibits a dual functionality.

The solutions illustrated above are advantageous in that the optical wave guide 17 per se can hardly be seen, thereby rendering this hearing device design relatively unnoticeable. The optical wave guide is even less visible, if, as mentioned, it is integrated into the electrical line and/or sound tube.

A further advantage of the exemplary embodiments illustrated consists in the optical microphone 13, but also the optical wave guide 17, being relatively small and thus saving on space. This enables the optical microphone to be easily accommodated in an otoplastic. In the event that the optical wave guide is integrated into the sound tube or the electrical line is integrated into the loudspeaker, fewer components are needed overall with a so-called RIC device (Receiver in the Channel), than with the exemplary embodiment in FIG. 2, thereby possibly rendering these variants more effective in terms of manufacturing costs.

The invention claimed is:

1. A behind-the-ear hearing device, comprising:

a housing to be worn behind the ear;

a signal processing facility arranged in the housing, said signal processing facility comprising an optoelectrical converter;

an optical microphone for optical signal transmission arranged outside the housing and to be positioned in the concha of the ear;

an optical wave guide that connects the optical microphone to the signal processing facility; and a loudspeaker or acoustic outlet in an auditory canal of the ear connected electrically or acoustically to the signal processing facility for transmitting sound to the auditory canal.

2. The behind-the-ear hearing device as claimed in claim 1, wherein the optical wave guide is a glass fiber cable.

3. The behind-the-ear hearing device as claimed in claim 1, further comprises an otoplastic onto which the optical microphone is fastened or into which the optical microphone is integrated.

4. The behind-the-ear hearing device as claimed in claim 3, wherein the otoplastic comprises the loudspeaker.

5. The behind-the-ear hearing device as claimed in claim 4, wherein an insulating tube of an electrical supply line of the loudspeaker being embodied as the optical wave guide in order to transmit the optical signal.

6. The behind-the-ear hearing device as claimed in claim 1, wherein the sound tube for transmitting sound to an auditory canal is attached to the housing and the sound tube simultaneously being used as the optical wave guide in order to transmit the optical signal.

7. A behind-the-ear hearing device, comprising:

a housing to be worn behind the ear;

a signal processing facility arranged in the housing, said signal processing facility comprising an optoelectrical converter;

an optical microphone for optical signal transmission arranged outside the housing and to be positioned in the auditory canal of the ear;

an optical wave guide that connects the optical microphone to the signal processing facility; and a loudspeaker or acoustic outlet in the auditory canal connected respectively electrically or acoustically to the signal processing facility for transmitting sound to the auditory canal.

8. The behind-the-ear hearing device as claimed in claim 7, wherein the optical wave guide is a glass fiber cable.

9. The behind-the-ear hearing device as claimed in claim 7, further comprises an otoplastic onto which the optical microphone is fastened or into which the optical microphone is integrated.

10. The behind-the-ear hearing device as claimed in claim 9, wherein the otoplastic comprises the loudspeaker.

11. The behind-the-ear hearing device as claimed in claim 10, wherein an insulating tube of an electrical supply line of the loudspeaker being embodied as the optical wave guide in order to transmit the optical signal.

12. The behind-the-ear hearing device as claimed in claim 7, wherein the sound tube for transmitting sound to an auditory canal is attached to the housing and the sound tube simultaneously being used as the optical wave guide in order to transmit the optical signal.

13. A method for recording sound for a behind-the-ear hearing device, comprising:

acoustooptically converting of the sound to be recorded in an auditory canal or in a concha into an optical signal;

optically transmitting the optical signal to a housing of the behind-the-ear hearing device; and optoelectrically converting the optical signal in the housing into an electrical signal for further processing via the behind-the-ear hearing device; and electrically or acoustically transmitting an output sound to the auditory canal by a loudspeaker or acoustic outlet in the auditory canal connected electrically or acoustically to the signal processing facility.

14. The method as claimed in claim 13, wherein the sound is recorded via an optical microphone arranged outside the housing.

15. The method as claimed in claim 13, wherein the optically transmitting the optical signal is via a glass fiber cable connecting the optical microphone to a signal processing facility in the housing of the behind-the-ear device.

* * * * *